United States Patent [19]

Cohen et al.

[11] Patent Number: 4,755,777

[45] Date of Patent: Jul. 5, 1988

[54] VARIABLE POWER DIVIDER

[75] Inventors: Nathaniel L. Cohen, San Diego; Ahmet D. Ergene, Carlsbad, both of Calif.

[73] Assignee: General Dynamics Corp./Convair Division, San Diego, Calif.

[21] Appl. No.: 835,404

[22] Filed: Mar. 3, 1986

[51] Int. Cl.[4] ..... H01P 5/16; H01P 1/161; H01P 1/165

[52] U.S. Cl. ..... 333/137; 333/21 A

[58] Field of Search ..... 333/117, 125, 137, 21 A

[56] References Cited

U.S. PATENT DOCUMENTS

| | | | |
|---|---|---|---|
| 2,628,278 | 2/1953 | Zaleski | 333/21 A X |
| 2,759,099 | 8/1956 | Olive | 333/137 X |
| 3,164,789 | 1/1965 | Grosbois et al. | 333/137 |
| 4,492,938 | 1/1985 | Young | 333/137 X |

*Primary Examiner*—Paul Gensler

*Attorney, Agent, or Firm*—John R. Duncan; Frank D. Gilliam

[57] ABSTRACT

A variable microwave power divider which includes an orthomode transducer having a first section capable of supporting a vertically polarized wave and a second section capable of supporting two orthogonal linearly polarized waves. Suitable probes for inserting or extracting RF energy are coupled to each section. A similar orthomode transducer is connected to the first transducer through a circular hollow waveguide with the transducers being angularly offset from one another a predetermined angular amount. A septum is positioned within the waveguide which is fixed thereto at one end with the other end being controlled to a predetermined spiral configuration in order to direct RF energy flowing through the waveguide to the sections of one transducer in a determinable manner.

11 Claims, 1 Drawing Sheet

VARIABLE POWER DIVIDER

BACKGROUND OF THE INVENTION

1. Field of the Invention

This invention relates generally to improvements in variable power dividers and more particularly, but not by way of limitation, to a mechanical variable power divider for use at microwave frequencies that is particularly adapted to adjust the distribution of RF power between two branches of a network, such network most typically being an antenna system on a communication satellite.

2. Description of the Invention

A need for variable power dividers has been well established in communication satellites. Typically, a modern satellite communications system requires that the antenna provide a number of separate beams operating on the same frequency, typically called "frequency reuse", and have means for switching or reconfiguring the beams to accommodate changing traffic patterns. Such changes in switching or reconfiguring the beams may occur frequently or infrequently depending upon the particular location and category of the traffic being handed.

The present invention provides means to alter the distribution of RF power in a microwave circuit between two paths under mechanical control. This alteration is accomplished with minimum losses, and over a wide band of frequencies (consistent with the bandwidth of the microwave circuit, which is usually a waveguide).

The invention is particularly useful in antenna feed distribution networks to permit adjustment of the distribution of RF power between two branches of the network, and conversely in receiving systems, the amount of power contributed by each branch. Such adjustment is required, typically, in an antenna system positioned on a communication satellite in order to alter the beam location and contour, upon command, to accommodate traffic requirements.

It also has the advantage of requiring very little power to operate and requires no power in standby mode. An additional advantage is that it is virtually independent of temperature variations, which is a great advantage over other devices using ferrite materials in either Faraday rotators or phase shifters used for similar purposes. It also has very low RF losses.

The following patents, while of interest in the general field to which the invention pertains, do not disclose the particular aspects of the invention that are of significant interest.

German Pat. No. 863828 dated Jan. 19, 1953 discloses the use of a spiral web of fixed geometry to rotate the plane of polarization of a signal in a wave guide in order to control the relative amounts of radiation from slots in the side of the waveguide. Such a fixed arrangement permits the design of an antenna array in which different segments have different amounts of energy. This patent does not disclose a web contained within a waveguide and having variable and controllable geometry to vary the plane of polarization to control the RF energy.

French Pat. No. 1,137,228 dated May 27, 1959 discloses a spiral septum or web of fixed geometry mounted on a rotatable shaft in a cavity having an "hourglass" shape. Rotation of the shaft moves the part of the septum in the narrow region of the hourglass shape in such a way as to vary the effective dimensions and, hence, change the resonant frequency. As before, the feature varying the shape of a spiral web within a circular waveguide to change the plane of polarization of RF energy a predetermined amount for the purpose of varying RF power is not seen.

U.S. Pat. No. 2,628,278 issued on Feb. 10, 1953 to John F. Zaleski discloses a device for rotating microwave energy. The device utilizes a rotary joint to orient a flexible septum positioned within a hollow waveguide. The rotary joint is rotated to very the septum to a fixed position for the purpose of rotating the RF energy of a fixed single input port to a fixed single output port without loss of RF energy. The purpose of this joint is to be able to position various system components with respect to each other with a minimum of waste space or to apply energy to or derive energy from a movable antenna structure. There is no intention to provide a variable power divider to divide power between two output ports.

U.S. Pat. No. 2,985,850 issued to Carl F. Crawford, et al. on May 23, 1961 shows a variable, highpower microwave power divider wherein a series of ganged individual rectangular waveguide sections are manually rotatable, by manipulation of a handle, relative to one another to create a rotated wave which is shared by two output ports. This device is mechanically complex and inherently lossy. The present invention employs only one single fixed circular waveguide while the Crawford, et al. device uses a plurality of waveguides and rotary joints, which multiplication of parts inherently increases a chance of failure in space.

U.S. Pat. No. 3,024,463 issued on Mar. 6, 1962 to Alvin W. Moeller, et al. for a feed assembly for circular or linear polarization uses a series of rotatable joined circular waveguide sections for adjusting the relative phase of a circularly polarized horn so as to produce a linearly polarized wave at a rectangular waveguide single port. As in the Crawford patent, the series of rotary joints is relatively inefficient, lossy and does not provide a variable power divider.

U.S. Pat. No. 3,296,558 issued to William J. Bleackley on Jan. 3, 1967 relates to a polarization converter comprising metal rods mounted on a torsion wire that twists when rotated. Bleackley provides a rotary joint in the outer wall of the waveguide that can be rotated to twist the torsion wire to determine the plane of polarization of the wave at a single output port. It does not disclose a variable power divider that uses a variable septum positioned within a circular hollow waveguide that may be varied without the use of external rotary joints.

SUMMARY OF THE INVENTION

In accordance with the present invention, there is provided a variable microwave power divider of considerably simpler design than heretofore available. The invention contemplates providing a first transducer means having one section capable of supporting a linearly polarized wave and another section capable of supporting two orthogonal linearly polarized waves at the same time. Hereafter, for clarity, but without limitation, these will be referred to as vertically and horizontally polarized waves respectively. A probe for inserting or extracting RF energy is coupled to each section of the first transducer. A second transducer means similar to the first and also having probes for extracting and inserting RF energy is provided.

A circular hollow waveguide means fixedly couples the first transducer means to the second transducer means. A variable means is positioned within the circular waveguide means and is adapted to be varied in order to shift RF energy flowing through the waveguide means between the probes provided in the two sections of a transducer means.

Other features and attandant advantages of the present invention will become apparent to those skilled in the art from a reading of the following detailed description constructed in accordance with the accompanying drawings and wherein:

DESCRIPTION OF THE PREFERRED EMBODIMENT

Figure 1:
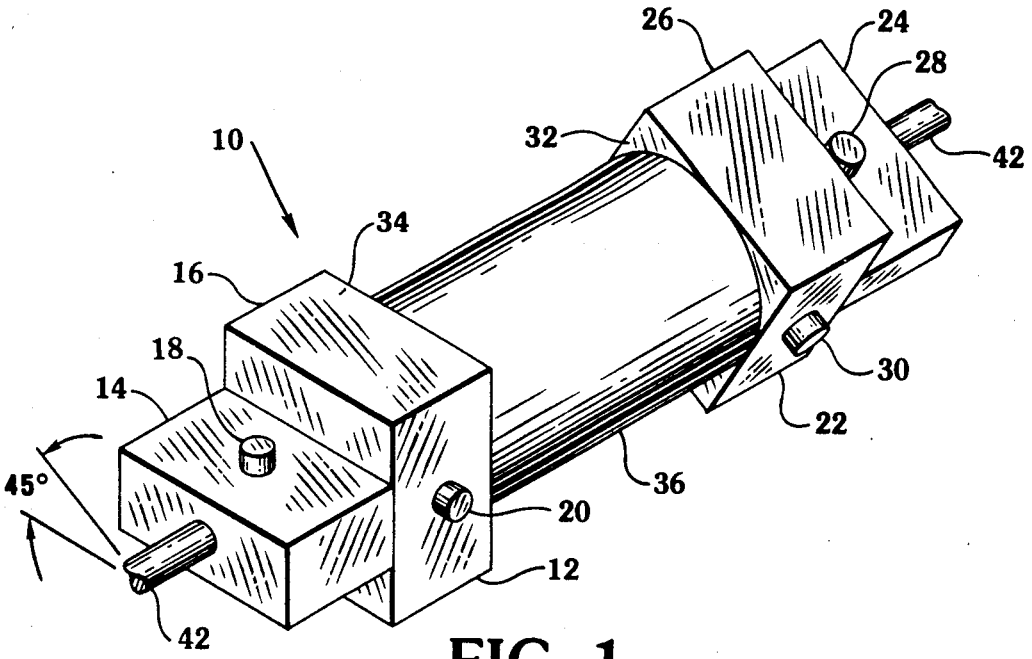
FIG. 1 illustrates a preferred embodiment of a microwave power divider constructed in accordance with the principles of the present invention.

Referring now to the drawings in detail and in particular to FIG. 1, the reference character 10 generally designates a varaible microwave power divider constructed in accordance with the present invention. The variable power divider 10 includes a first orthomode transducer 12 having one section 14 which is a rectangular waveguide capable of supporting a vertically polarized wave and a second section 16 which is a square waveguide capable of supporting both horizontal and a vertically polarized wave at the same time. Each section 14 and 16 have coupled to it probes 18 and 20 for extracting or inserting RF energy into the transducer 12. In the illustrated embodiment these probes are shown as suitable coaxial connectors but the method of coupling is not so limited.

A second similar orthomode transducer 22 having a first section 24 and a second section 26 is provided. As before, the first section 24 is a rectangular waveguide which supports a vertically polarized wave and the second section 26 is a square waveguide capable of supporting both a horizontal and a vertically polarized wave at the same time. Each section 24 and 26 is provided with a suitable probe 28 and 30 for extracting energy or inserting RF energy into the orthomode transducer 22.

The second transducer 22 is fixedly coupled to the first transducer 12 through a circular hollow waveguide 36 and suitable apertures 32 and 34 are interposed between the transducers 12 and 22 and the waveguide 36. It is to be noted in FIG. 1 that the second transducer 22 is rotated 45 degrees about the horizontal axis of the divider 10 with respect to the first transducer 12.

Figure 2:
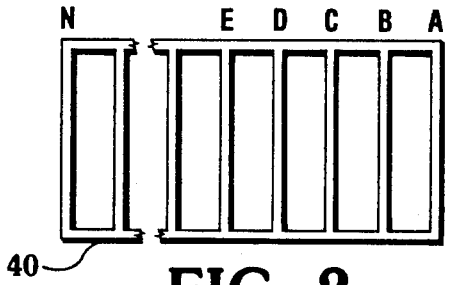
FIG. 2 shows a simplified spiral plate rotator, which concept is used as a control means in the variable power divider of FIG. 1.

A variable control means is positioned within the circular waveguide 36 and adapted to be varied in order to shift the RF energy between the probes provided in the two sections of one of the transducers 12 and 22. Referring now to FIG. 2 the principle of this control means will be discussed. FIG. 2 shows a plurality of spaced thin flat strips A–N joined together at their outer extremities by two spaced longitudinally extending strips 38 and 40. The parallel flat strips A–N are thin and composed of a highly conductive material. The longitudinally extending strips are similarly thin and may be composed of either a conductive or a non-conductive material but in either event must be composed of a highly flexible material.

Figure 2A:
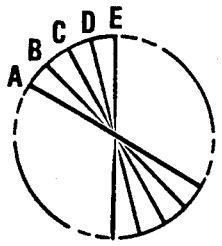
FIG. 2A is an end view of the rotator of FIG. 1 and demonstrating how it may be twisted to rotate the plane of polarization.
Figure 2B:
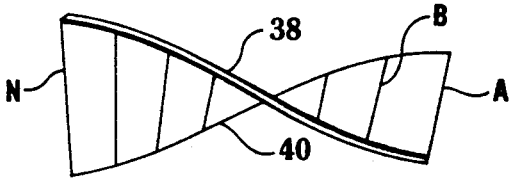
FIG. 2B is a perspective view of the spiral plate rotator of FIG. 1 and showing how the rotator affords 90 degree rotation over a very short length.

Referring to FIGS. 2A and 2B, it will be seen that if one end of the thin plate comprising the illustrated spiral plate rotator is fixed and the other end is rotated a predetermined angular amount, the sectional plane of the plate may be rotated 90 degrees within a very short length.

It is well known that a guided wave such a wave which can be propagated within the circular waveguide 36 can be separated into two orthogonal waves or modes which add up vectorally to the original wave. It is also known that a lateral conductor in a waveguide causes the establishment of such modes whenever it is not perpendicular to the plane of polarization of the incident wave. One of the created modes is perpendicular to the conductor and the other is parallel to it, but is propagated only as a reflected wave. If the lateral conductor makes only a small angle with the incident wave, only a small amount of power is reflected, and the mismatch is low while the ongoing incident wave has been rotated by that angle. If the wave later encounters another lateral conductor it again gets rotated. It is clear that by passing through a waveguide containing a spiral plate rotator as shown in FIGS. 2, 2A, and 2B the wave will be rotated by an amount determined by the twist in the spiral.

If a spiral plate rotator of the type shown were to be positioned within the waveguide 36 with the left end of the locator lying in a horizontal plane and the right end be rotated 45 degrees clockwise, all of the energy flowing from the second tranducer 22 would be coupled to the port 18 of first transducer 12.

If the plate rotator were to be flat within the circular waveguide 36, half of the energy flowing to the first transducer 12 from the second transducer 22 would be coupled to each of the output ports 18 and 20. Thus, it will be respect to the other will cause a shift in the amounts of power being transferred from the input to the two output ports. If large mismatches are avoided, substantially all of the power will be transferred so that the total output power will be substantially the same as the input power.

Figure 3:
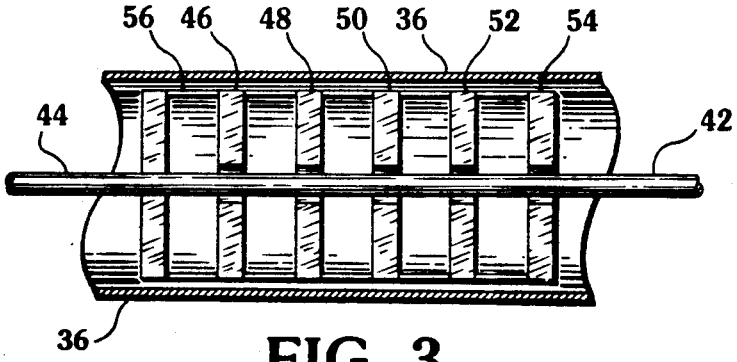
FIG. 3 shows the variable control means of the variable power divider of FIG. 1 as contained within the circular waveguide means.

Referring now to FIG. 3 it will be seen how the plate rotator of FIG. 2 is implemented in the variable power divider 10 of FIG. 1. A rod 42 extends longitudinally along the longitudinal axis of the divider 10 and is suitably journaled in the first and second orthogonal transducer sections 12 and 22. The rod 42 has a thin highly conductive strip 44 fixed to it on one end. A plurality of similarly shaped strips 46–54 are longitudinally spaced from the strip 44 and connected to one another by means of flexible connectors 56. Alternatively, two longitudinal strips may be used in place of the connectors 56 to connect the strips 44–54 into one flexible thin plate. The strip 54 is suitably connected at its outer end to the circular waveguide 36.

Figure 4:
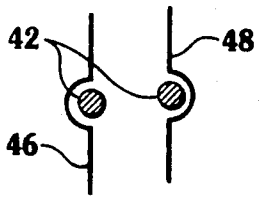
FIG. 4A is a fragmentary sectional detail view of a typical variable control means unattached and conformed for positioning around the control rod of the variable power divider of FIG. 3.
FIG. 4B is the same showing as FIG. 4A with the variable control means conformed to be positioned around the opposite side of the control rod.

It will be seen in FIGS. 4A and 4B how the strips 46–54 have a deformed central section that permits the rod 42 to be rotated without causing a similar degree of rotation of each strip. Thus, the left hand side of the spiral plate rotator in FIG. 3 is fixed to the rod 42 while the right hand side of the rotator is fixed only to the circular waveguide 36 and the intermediate strips 46–52 are interconnected to one another and at each end to strip 44 and at the other end to strip 54.

Thus, rotation of the shaft 42 a predetermined angle will cause strip 44 to rotate and all of the strips between strip 44 and strip 54 will rotate an amount proportional to their distance from the fixed strip 54. They remain in place by the action of the strong springlike property of the interconnecting members 56, avoiding any contact with the shaft 42 and thereby avoiding any unnecessary friction. By rotating the second transducer means 22 at 45 degrees from the first transducer 12, it is clear that one can secure a total shift from full power at one output port to full power at the port orthogonal thereto by rotating the control shaft 42 plus or minus 45 degrees about a neutral position.

Although the present invention has been shown and described with reference to a particular embodiment, nevertheless, various changes and modifications obvious to one skilled in the art to which the invention pertains are deemed within the purview of the invention.

What is claimed is:

1. A variable microwave power divider comprising:

(a) a first transducer means having one section capable of supporting a vertically polarized wave and another section capable of supporting both a horizontally and vertically polarized wave at the same time, a probe for inserting or extracting RF energy coupled to each section of the first transducer means, (b) a second transducer means means having one section capable of supporting a vertically polarized wave and another section capable of supporting both a horizontally and vertically polarized wave at the same time, a probe for inserting or extracting RF energy coupled to each section of the second transducer, the second transducer means being rotated a predetermined amount about the longitudinal axis of the divider with respect to the first transducer means, (c) a circular hollow wave guide means fixedly coupling the first transducer means to the second transducer means, and (d) variable means positioned within the circular wave guide means and adapted to be varied in order to shift the plane of polarization of the RF energy flowing through the wave guide means between the probes provided in the two sections of said transducer means.

2. The variable microwave power divider of claim 1 wherein the probes connected to the two sections of the first and second transducer means are orthogonally disposed so that the variable means can shift the RF energy from full power to zero power for each section of each transducer means.

3. The variable microwave power divider of claim 1 wherein the variable means comprises a thin plate extending longitudinally within the circular waveguide means, said plate being fixed at one to the circular waveguide means and being rotatable at the other end whereby the plate may be twisted to a predetermined configuration.

4. The variable microwave power divider of claim 3 wherein means extend longitudinally through one transducer means and fixedly engages the rotatable end of the plate, rotation of said means causes a predetermined twisting of the thin plate extending through the circular waveguide means and thereby directs the RF energy entering one transducer means to be divided in a predetermined manner between the probes in the two transducer sections.

5. The variable microwave power divider of claim 4 wherein the thin plate extending through the circular waveguide means consists of a plurality of normally planarly aligned strips which are flexibly interconnected.

6. The variable microwave power divider of claim 5 wherein the thin plate extending through circular waveguide means is connected at one end to the circular waveguide means and is connected at its other end to a variable control means.

7. The variable microwave power divider of claim 6 wherein said variable control means comprises a longitudinally extending rotatable rod means which extends through one transducer means and into the circular waveguide section for connection to the thin plate.

8. The variable microwave power divider of claim 1 wherein each transducer means comprises an orthomode transducer having said two sections.

9. The variable microwave power divider of claim 2 wherein each transducer means is coupled by an iris to the circular waveguide means.

10. The variable microwave power divider of claim 9 wherein each probe for extracting or inserting RF energy comprises a coaxial connector.

11. The variable power divider of claim 1 wherein the second transducer means is rotated 45 degrees from the first transducer means along the longitudinal axis of the divider.

* * * * *